United States Patent [19]

Davis

[11] 4,175,619

[45] Nov. 27, 1979

[54] WELL COLLAR OR SHOE AND CEMENTING/DRILLING PROCESS

[76] Inventor: Carl A. Davis, P.O. Box 12326, Houston, Tex. 77017

[21] Appl. No.: 941,166

[22] Filed: Sep. 11, 1978

[51] Int. Cl.[2] ..... E21B 33/16

[52] U.S. Cl. ..... 166/291; 166/153; 166/193

[58] Field of Search ..... 166/99, 153, 192, 193, 166/237, 238, 242, 285, 291

[56] References Cited

U.S. PATENT DOCUMENTS

| | | | |
|---|---|---|---|
| 2,165,433 | 7/1939 | Wickersham | 166/153 |
| 3,545,543 | 12/1970 | Kammerer, Jr. et al. | 166/242 X |
| 3,581,817 | 6/1971 | Kammerer, Jr. | 166/285 X |
| 3,913,686 | 10/1975 | Manson, Jr. | 166/242 X |

*Primary Examiner*—Stephen J. Novosad
*Assistant Examiner*—George A. Suchfield

[57] ABSTRACT

An improved well shoe or collar has at least one tooth protruding from the top of the cement shoulder of the shoe or collar capable of engaging, denting and penetrating a pump down wipe plug and retarding the tendency of the plug to rotate when engaged by a drilling bit, thereby enhancing the drilling action of a drill bit on a pump down wipe plug. An improved process of cementing within a well and drilling through a plug comprises inserting a pump down wipe plug at the interface of a fluid and wet cement, pumping the plug down the well until it comes into contact with a shoulder of a shoe or collar having at least one protrusion extending from the surface of the shoulder capable of engaging, denting and penetrating the plug, subsequently after the cement has set, lowering a drill bit onto the top of the plug, the protrusion retarding the tendency of the plug to rotate with the rotating action of the drill bit and enhancing the drilling action of the bit.

10 Claims, 9 Drawing Figures

FIG. 5
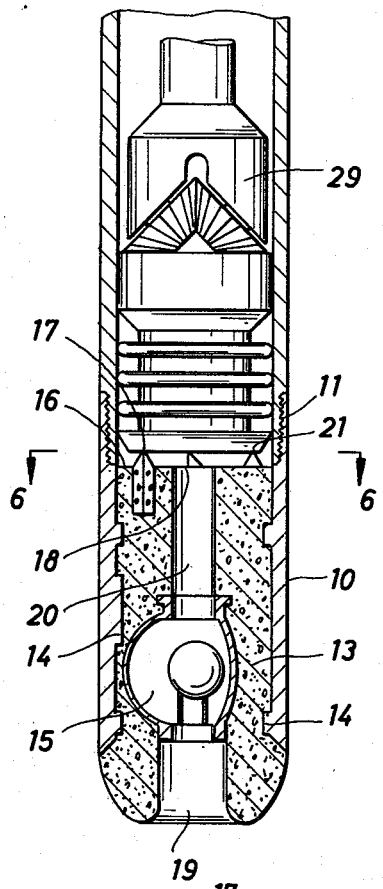
FIG. 7
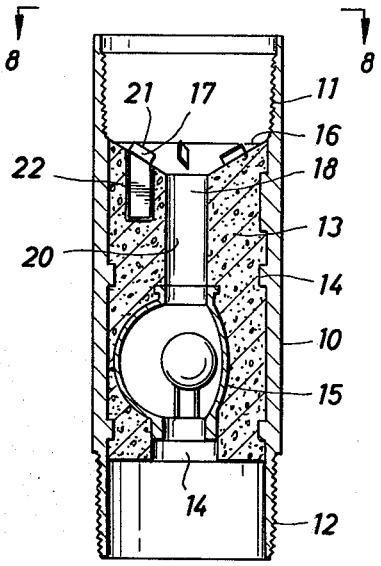
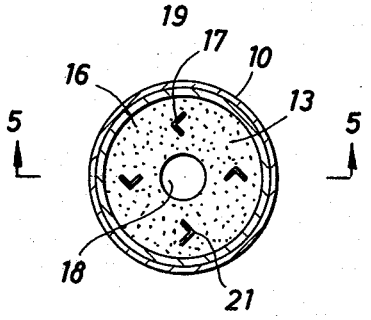
FIG. 6
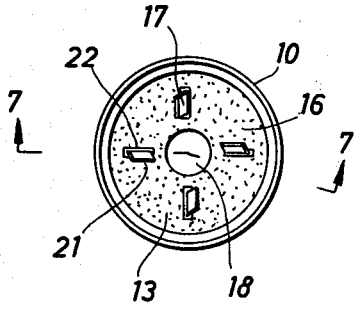
FIG. 8
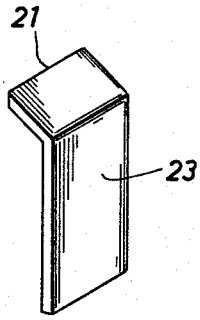
FIG. 10
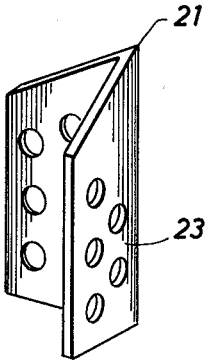
FIG. 9

WELL COLLAR OR SHOE AND CEMENTING/DRILLING PROCESS

BACKGROUND OF THE INVENTION

The cementing process is one of the most important processes in drilling and completing a well. It is an intimate part of the running of casing. Cementing is done at various points in the well and at various times while drilling both inside and outside of the casing.

The primary cementing can form a protective sheath around the casing, segregating producing formations to prevent migration of undesirable fluids. Secondary cementing takes place after the primary cementing and can be used to squeeze cement into the perforations in the casing or to seal off, isolate or repair parts of the well. Plug back cementing is used to place cement at desired points in the well or to shut off the bottom water or reduce the depth of the well.

Two of the apparatuses or pipe attachments routinely used in the cementing operations are the collar and the shoe. These are typically cement restrictions or shoulders which are attached to a pipe string as a part of the pipe string. The collar, for example a float collar, is inserted between the top and bottom of a casing string usually one or two joints above a float shoe which is attached to the bottom of a pipe string. Shoes and collars, among a number of things, help prevent the back flow of cement during the cementing operation. The collars and the shoes are usually equipped with a check valve (often a ball valve means) to aid in the prevention of back flow of cement. The shoes and collars are typically an outer cylindrical housing or pipe and an inner cement tube communicating with and fixed to the inner surface of the cylindrical housing, with a fluid passage running the length of the cement tube. When there is a check valve, it is usually part of an inner housing in concentric spaced relationship with the outer housing so that the cement tube fills the space between the two housings and the inner housing forms part of the fluid passage.

In addition to the collars and shoes typical cementing operations employ one or more pump down plugs. Pump down wipe plugs can serve three purposes: (1) to separate or serve as the interface between the wet cement from the fluid it is displacing or the fluid which is being used to pump the wet cement to the desired level; (2) to wipe off the inner surface of the pipe string as it passes; and (3) to help prevent back flow while the cement is setting up.

In practice the well operator makes up his pipe string so that the collar or shoe is lowered into the well to the desired level. When he decides to cement he may place a bottom pump down wipe plug between the fluid already in the well and the wet cement. This bottom plug has a fluid passage through it which is sealed by a diaphragm or membrane. The cement is pumped into the well forcing the bottom plug down the well, displacing the fluid in front of it, until it reaches the top of the cement tube of the shoe or collar or shoulder. This restriction stops the plug and increased pumping pressure breaks the diaphragm or membrane and the cement passes through the plug and through the fluid passage of the collar or shoe. After the desired amount of cement is pumped into the well a top pump down wipe plug is inserted to act as the interface between the fluid used to force the cement to the desired level for the cement. Often the bottom plug is not used and only one plug as the interface between the cement and the fluid used to force the cement to the desired level is used. The top plug is usually pumped until it comes in contact with the bottom plug if one is used or the top of the cement tube part of the shoe or collar. The cement is allowed to set or harden and the well operator then carries out whatever other operations he intends to do.

The plugs used in the above operation are usually made of a pliable or rubbery material, such as plastic, wood or rubber, sometimes with hollow metal or plastic cores and they fit snugly in the pipe string. All of the plug is made of drillable material.

Once the cement has set up and the well operator has carried out his desired operations he may decide to drill out the plug and/or plugs, collar or shoe and the cement. The plugs are typically made of drillable material, as are the cement tube and and innerhousing of the collar and shoe and of course, the cement which was pumped into the well. The well operator lowers the drill string into the well until the drill bit contacts the plug and he begins to drill by rotating the drill bit, usually clockwise. In many instances the rotation of the drill bit will cause the plug with which it is in contact to rotate, slipping over the surface on which it rests, i.e., cement, a bottom plug or the cement tube of the shoe or collar. This tendency of the plug to rotate as the bit rotates, to slide across the surface below it, wastes both time and energy. Since all of the components are made of readily drillable material, this wasting of time and energy in the drilling process is an unnecessary problem.

The present invention is an apparatus and process for drilling through a pump down wipe plug/shoe or collar cement shoulder combination.

FIELD OF THE INVENTION

The invention relates to an apparatus for improving the process of drilling through the combination of plug and cement string restriction. The invention also relates to an improved well pipe attachment. The invention further relates to improved float or baffle collars and shoes. The invention particularly relates to a collar or shoe having one or more protrusions, teeth, projections or nodes on its top surface. It relates to collars or shoes where the top cement surface has been molded so that there are cement protrusions, i.e., ridges or sharp mounds on the top surface. It relates to a collar or shoe having one or more spikes fixed to or anchored into and protruding above the upper surface of the collar or shoe. The invention further relates to a method of drilling through a plug/well pipe attachment (collar or shoe) combination where the plug is in contact with the upper surface of the well attachment and the upper surface of the well attachment is equipped with protrusions, teeth or spikes that engage the plug, the bit engages the top of the plug pressing it on to the protrusions or spikes which retard the plug's tendency to slip or rotate over the top surface of the well attachment, thus allowing the bit to drill through the plug.

SUMMARY OF THE INVENTION

An improved cement restriction apparatus in a well pipe adapted to receive a pump down wipe plug where the top surface of the cement restriction has at least one drillable projection or tooth-like means protruding from its surface. An improved cement collar or shoe where the top surface of the collar or shoe has been molded so that at least one cement projection or tooth-like means protrudes from its surface. An improved collar or shoe adapted to receive a pump down wipe plug where the top surface of the cement has one or more projections or tooth-like means. The collar or shoe where the projections are drillable spikes or blades imbedded in the cement and protruding upward and out of the top surface of the cement. This or these spikes, teeth or blades like means are made of material substantially stronger than the plug and capable of denting, penetrating and rending the material of the plug. These spikes, teeth or blades are made of drillable metals, woods or plastics.

An improved process of drilling through a pump down wipe plug/collar or shoe combination where the drill string is lowered until it contacts the top of a pump down wipe plug, the bottom of said plug is in communication with the top of a collar or shoe, and the top of the collar or shoe is equipped with at least one protrusion or tooth-like meaks made of a drillable material strong enough to dent, penetrate and rend the plug, the interaction of the rotation of the drill bit on the top of the plug and the retarding effect of the protrusions or teeth on the bottom of the plug aids the drill bit to drill through the plug saving both time and energy.

BRIEF DESCRIPTION OF THE DRAWINGS

FIG. 5 is a sectional view of the shoe of FIG. 6 along the line 5-5' showing projections that were made of drillable material other than cement that have been molded into the shoe.

FIG. 6 is a view from above of the shoe top surface of FIG. 5.

FIG. 7 is a sectional view of the collar of FIG. 8 along the line 707' showing projections made of drillable material other than cement where the projections which are blades that fit into slots and where the portion extending above the surface of the collar is at an angle relative to the vertical which is counter-clockwise.

FIG. 8 is a view from above of the collar of FIG. 7.

FIG. 9 is an enlarged view of the blade used in the shoe of FIGS. 7 and 8.

DESCRIPTION OF THE PREFERRED EMBODIMENTS

As used in the description of this invention a cement pipe restriction refers to a collar or shoe used in drilling operations having a cement shoulder. These collars or shoes can be of the cement float type, cement baffle type, cement guide type, or the like.

Figure 1:
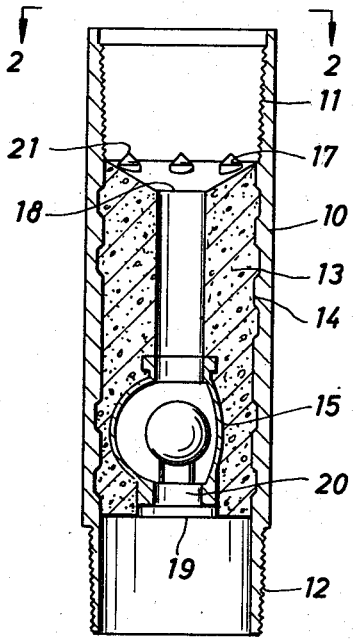
FIG. 1 is a sectional view of the collar of FIG. 2 along the line 1-1' showing molded cement projections shaped like pyramids.
Figure 3:
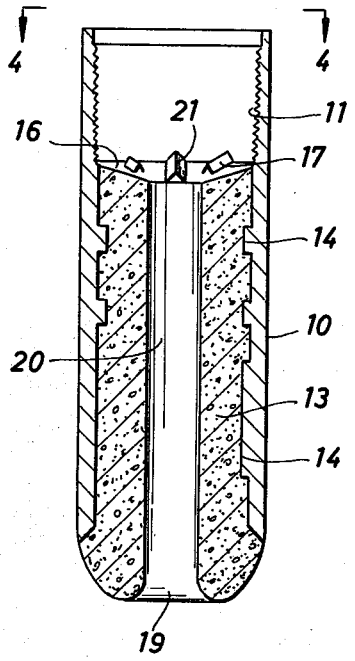
FIG. 3 is a sectional view of the shoe of FIG. 4 along line 3-3' showing molded cement projections shaped like blades.
Figure 2:
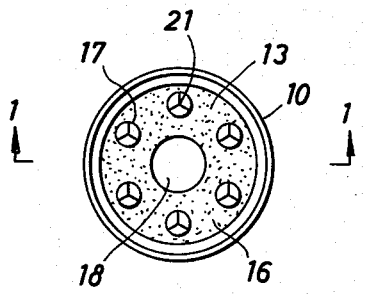
FIG. 2 is a view of the top surface of the collar of FIG. 1 from above.
Figure 4:
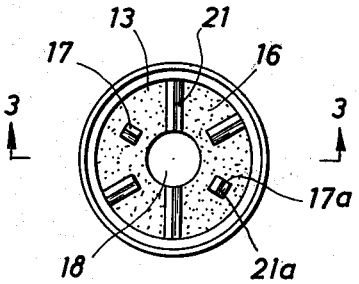
FIG. 4 is a view of the top surface of the shoe of FIG. 3 from above.

Referring to the FIGS. 1–8 a cement pipe restriction is made of a pipe or cylindrical housing member 10, having a top attachment means 11, usually female threads, and in the case of the collar, a bottom attachment means 12, usually male threads, to enable the collar or shoe to be attached to a pipe string. Inside the housing member 10 is a cement tube 13, the outer surface of the cement tube 13 communicating with and fixed to the inner surface of the pipe 10. This is usually done by having the inner surface of the pipe 10 equipped with both radial and longitudial ribs 15. The cement tube 13 has a top opening 18 and a bottom opening 19 with a passage 20 in fluid communication with the top and bottom openings 18 and 19. Optionally the passage 20 is equipped with a valve 15 as in FIGS. 1, 5 and 7.

The top surface of the cement tube 16 which is below the top attachment means is adapted to receive a pump down wipe plug. The top surface of the cement tube 16 can be flat, i.e., perpendicular to a line running through the center of the length of the pipe 10 and cement tube 13 as in FIG. 5. The top surface 16 may also slope inwardly and downwardly as in FIGS. 1, 3 and 7, or even, inwardly and upwardly. The cement tube 13 and the valve 15 are made of drillable material.

Protruding from the top surface of the cement tube 16 is at least one protrusion or tooth-like element 17. As used in the description of this invention, a protrusion is a drillable object of any shape extending at least 1.27 centimeters above the top surface of the cement tube 16, capable of engaging and retarding the rotation or slipping of the plug over the top surface of the cement tube 16 caused by the action of the bit on the plug. The protrusion or tooth-like means must be made of a material strong enough to dent, penetrate, hold, and rend the plug. Pump down wipe plugs are usually made of drillable rubber, plastic or other friable or rubbery material. The preferred materials for the protrusion or tooth-like means 17 are cement, metal, wood or plastic. The most preferred materials are metals and of the metals, cast iron and aluminum are preferred, aluminum being the most preferred. The protrusion 17 must be high enough to engage dent, penetrate, hold and rend the plug, but it is preferred that the protrusions be between about 1.27 and about 10 centimeters, more preferably between about 1.27 and about 7 centimeters and most preferably between about 2.54 and about 5 centimeters high above the top surface 16 of the cement tube 13. It is preferred that the protrusions 17 have tops 21 that are sharp, preferably pointed as in FIGS. 1, 2, 5, 6 and 9, or forming a sharp edge or blade as in FIGS. 3, 4, 7, 8 and 10. The height of the protrusion 17 is dependent on the fit between the pump down wipe plug and the top surface of the cement tube 16 and on the ease with which the protrusion 17 engages the material of the plug. The sharpness of the top of the protrusion 21 is also dependent on the ease with which it engages the plug material. In a preferred embodiment the top of the protrusion 21 is shaped as a series of teeth or barbs, i.e., like a saw.

The number of protrusions 17 is between 1 and about 10 inclusive, preferably between 2 and 8 inclusive, and most preferably between 3 and 6 inclusive. The number of protrusions 17 is dependent on the size of the top surface 16 of the cement tube 13 and the height of the protrusions 17. The greater the area of the top surface of the cement tube 16 and the smaller the protrusions 17 the larger the number of protrusions 17 is needed. The preferred spacing of the protrusions 17 on the top surface 16 of the cement tube 13 is one where the distance between protrusions 17 is maximized but if the protrusions 17 were placed on a single line from the center of the top opening 18 to the pipe 10 without changing the radial distance from the center of the opening 18, there would be a maximum and equal distance between each protrusion 17.

A preferred embodiment of the invention where the protrusions 17 are molded of cement is illustrated in FIGS. 1–4. This embodiment may be made by using as part of the form for casting the cement tube 13, the female counterpart of the protrusions. This form would be in contact with the top of the cement tube while the cement sets up. The protrusions 17 must have sharp tops 21 in order to engage the bottom of the plug and to prevent or impede its rotation or slipping over the top surface 16 of the cement tube 13. The sharp tops can be either points as the protrusions of FIGS. 1 and 2 or blades or wedges as in FIGS. 3 and 4. The wedge shape protrusions 17 may have their sharp edge 21 running parallel to a line from the center of the opening 18 to the pipe 10 or tangent to a circle about the center of the opening 18 as in FIG. 4, 17*a* and 21*a*.

The size of the cement protrusion 17 and the type of cement must be such that the torque exerted by the plug when engaged by the drilling bit will not break the cement protrusion 17. At the same time the top edge 21 must be sharp enough (or the plug material soft enough) to allow the protrusion to engage the bottom of the plug.

Another embodiment of the invention is illustrated in FIGS. 5–10. In this embodiment the protrusion 17 is made of drillable metal, wood or plastic strong enough to engage, dent, penetrate, retard, hold and rend the plug as torque is applied by the motion of the drill bit on the top of the plug. The protrusion 17 of the embodiment illustrated in FIGS. 5 and 6 is part of an element such as a drillable spike, rod, bar or angle iron 23 that has been permanently fixed in the cement tube 13 by casting the bottom of the spike, bar, rod or angle iron 23 as part of or into the cement tube 13. The spikes, bars, rods or angle irons 23 typically have a plurality of holes through them or ribs on them to assist in anchoring them into the cement. The wet cement bridges through the holes or forms around the ribs and on drying holds the protrusions 17 in place.

In another embodiment illustrated in FIGS. 7 and 8, the protrusions are part of drillable rods, spikes, bars or angle irons 23 which may be readily slipped or fitted into pockets 22 when needed. The collar or shoe is made so that pockets 22 are formed in the cement tube 13 with openings on the top surface of the cement tube 16. When needed the protrusions 17 may be formed by inserting spikes, rods, bars or angle irons 23, depending on the shape of the pocket 22, into the pocket 22 so that a portion protrudes above the surface 16.

These spikes, rods, bars and angle irons 23 can be between about 4 and about 30, preferably between about 5 and about 25 and most preferably between about 6 and about 24 centimeters in length.

The shape of the protrusion can be pointed as in FIG. 9 or wedge or blade like as in FIG. 10. In most drilling operations the drilling is done by rotating the bit in the clockwise direction. In one embodiment of the invention, to enhance the ability of the protrusions to retard the rotation of the plug, it is preferred that the point or edge be angled counter clockwise as in FIGS. 5–10.

The process of this invention (pictured in FIG. 5) comprises drilling through a plug/collar or shoe combination where a drill bit 24 is lowered into the well and brought in contact with the top of a drillable pump down wipe plug 25, forcing the bottom of the plug to be engaged by protrusions 17 which protrude from the top surface 16 of the cement tube 13 of a collar or shoe, the bit is rotated and the plug 24 is held stationary by the protrusions 17 and the bit drills through the plug 24, then the protrusions 17 and finally the cement tube portion of the collar or tube.

This drilling process is part of the cementing/drilling process. The improved collar or shoe is placed in the pipe or casing string, lowered to the desired depth and a pump down wipe plug 25 pumped down as the interface between a wet cement portion and another fluid portion, the plug 25 stops when it comes into contact with and is forced onto the protrusions 17. Once the cement has set up and the well operator elects to drill out the plug 25 and the cement tube 13 of the shoe or collar, a drill bit 24 is lowered on a drill string until it contacts the plug 25 and forces the plug 25 down so that the protrusion 17 dents or penetrates the bottom of the plug even further. The rotating drill bit 24 can either drill away the upper portion of the plug 25 with the protrusions holding the plug stationary or force the plug to rotate thereby causing the protrusions 17 to rend the bottom of the plug thereby drilling the plug from the bottom.

The preferred embodiment of the process is to have the plug held stationary by the protrusions 17 and the drill bit 24 drill the plug 25 away from the top. Since the plug 25, protrusions 17 and cement tube 13 are all made of drillable material the combination of plug 25, the cement tube 13 and protrusions 17 can be easily drilled out.

For two actual situations where the plug and the cement tube combinations were essentially the same except that one of the cement tubes was equipped with protrusions, it was observed that it took about twice as long to drill through the plug/cement tube combination as it did to drill through the plug/protrusion/cement tube combination.

I claim as my invention:

1. In a well shoe or collar pipe attachment having a cement tube adapted to receive a pump down wipe plug, the improvement which consists of at least one drillable protrusion extending upward from the top surface of the cement tube, said protrusion having a sharp upper end capable of engaging, denting, penetrating and rending a pump down wipe plug and strong enough to withstand the torque exerted by the tendency of a pump down wipe plug to rotate when in contact with a rotating drill bit.

2. The improved attachment of claim 1 where the protrusion extends at least 1.27 centimeters above the top surface of the cement tube.

3. The improved pipe attachment of claim 2 where the protrusion is made of cement.

4. The improved pipe attachment of claim 2 where the protrusion is made of a material selected from the group consisting of drillable metal, plastic and wood.

5. The improved pipe attachment of claim 4 where the protrusion is part of an element selected from the group consisting of a rod, bar or angle iron between about 4 and about 30 centimeters long extending below and into the surface of the cement tube.

6. The improved pipe attachment of claim 5 where the number of protrusions is between 3 and 6 inclusive.

7. The improved pipe attachment of claim 6 where the protrusion is made of aluminum.

8. In a well shoe or collar pipe attachment having a cement tube adapted to receive a pump down wipe plug, the improvement which consist of from 3 to 6 pointed aluminum teeth extending at least 1.27 centimeters above the top surface of cement tube, said teeth being part of a rod between about 4 and about 30 centimeters long which extends into the top surface and are fixed in the cement tube so that the teeth are capable of engaging, denting, penetrating and rending a pump down wipe plug, thereby retarding the tendency of the plug to rotate when engaged by a rotating drilling bit, enhancing the drilling action of the bit on the plug.

9. An improved well cementing and drilling process comprising:

(a) pumping wet cement into the well pipe string;

(b) inserting a top pump down wipe plug between the wet cement and a forcing fluid used to pump the wet cement to the desired level;

(c) pumping the plug and the wet cement down the well with the forcing fluid until the bottom of the plug contacts the top of a cement tube of a well shoe or collar pipe attachment having at least one drillable tooth-like means capable of engaging; denting, penetrating and rending said plug;

(d) allowing the cement to harden;

(e) contacting the top of the plug with a rotating drill bit so that the bottom of the plug is forced on to the tooth-like means thereby retarding the tendency of the plug to rotate and enhancing the drilling action of the bit on the plug.

10. An improved well cementing and drilling process comprising:

(a) inserting a bottom pump down wipe plug into the pipe string, followed immediately by;

(b) pumping the desired amount of wet cement into the pipe string;

(c) pumping the plug/wet cement down the string until the bottom of the plug contacts the top of a cement tube of a well shoe or collar pipe attachment having at least one drillable tooth-like means capable of engaging, denting, penetrating and rending said plug;

(d) forcing the wet cement through the bottom plug and through the pipe attachment and allowing it to harden;

(e) contacting the top of the plug with a rotating drill bit so that the bottom of the plug is forced on to the tooth like means, thereby retarding the tendency of the plug to rotate and enhancing the drilling action of the bit.

* * * * *